US010927550B1

(12) United States Patent
Cline et al.

(10) Patent No.: US 10,927,550 B1
(45) Date of Patent: Feb. 23, 2021

(54) EXTERNAL VENTS

(71) Applicant: Lifetime Tool & Building Products, LLC, Winchester, VA (US)

(72) Inventors: Roger Cline, Bluemont, VA (US); Mark Maclean-Blevins, Westminster, MD (US)

(73) Assignee: Lifetime Tool & Building Products, LLC, Winchester, VA (US)

( * ) Notice: Subject to any disclaimer, the term of this patent is extended or adjusted under 35 U.S.C. 154(b) by 0 days.

(21) Appl. No.: 16/369,338

(22) Filed: Mar. 29, 2019

Related U.S. Application Data

(60) Provisional application No. 62/650,104, filed on Mar. 29, 2018.

(51) Int. Cl.
*E04D 13/143* (2006.01)
*E04D 13/00* (2006.01)

(52) U.S. Cl.
CPC ..... *E04D 13/143* (2013.01); *E04D 13/004* (2013.01)

(58) Field of Classification Search
CPC ..... E04D 13/1476; E04D 13/14
USPC ..... 403/325
See application file for complete search history.

(56) References Cited

U.S. PATENT DOCUMENTS 4,512,119 A * 4/1985 Willoughby ..... E04D 13/1476 285/43
8,429,860 B2 * 4/2013 Kugler ..... E04D 11/007 403/187
2009/0013620 A1 * 1/2009 West ..... E04D 13/17 52/198

* cited by examiner

*Primary Examiner* — Patrick J Maestri
(74) *Attorney, Agent, or Firm* — James Creighton Wray

(57) ABSTRACT

A sloped roof vent has a coated steel plate with a raised center and a gasket receiver is formed around a central hole. A structural body is crimped with a gasket in the receiver. The body has an outer wall extending downward over the receiver. A sloping wall extends inward and a vertical wall supports a second sloping wall with an inner rim. A damper staked to an axle covers the rim. Inserts keep the damper from chattering and fully closing. Wind walls prevent outer drafts from lifting the damper. Two fasteners attach caps to the outer wall. Lanced and pressed ledges on a push-in hose connector permanently engage windows on the inner rim of the structural body. A snap-in screen and a hose connector reducer complete a package.

20 Claims, 15 Drawing Sheets

EXTERNAL VENTS

This application claims the benefit of U.S. Provisional Application No. 62/650,104 filed Mar. 29, 2018, which is hereby incorporated by reference in its entirety as if fully set forth herein.

BACKGROUND OF THE INVENTION

Venting of exhaust air or gases is required from within the environmentally controlled spaces of a building, such as the powered forced air venting of bathroom spaces to exhaust foul odors and moisture, and such as the powered forced air exhaust from a clothes drying appliance. Another example is the powered forced air exhaust from a kitchen range hood exhausting hot moist air from the cooking surfaces and activity.

In numerous situations it is desirable to provide this ventilation through the roof of a building. Where the gases to be exhausted originate within the building and are forced by fan or other means, a roof exhaust vent placement might provide the shortest length of duct resulting in the least pressure drop and the best performance for the given installation. Architectural design has evolved over the years and the common household laundry room, once located in the basement of the dwelling, is now located near to the bedrooms for easy access to the laundry facilities. This new, more up to date laundry access location will often put these facilities on the upper floors of the home, making a roof exhaust ideal for the optimum performance of the clothes dryer appliance. Likewise, bathroom facilities are now either integrated into or located adjacent to bedrooms, again on the upper floors of the dwelling and, like the clothes dryer installations, can perform best with the shortest run of exhaust duct; hence, a through the roof vent is a logical selection for best performance. Unlike the passive attic space ventilation application, the powered exhaust ventilation application must allow for periodic cleaning of the powered exhaust duct connected to the fan or blower used to motivate the airflow through the duct and then through the roof mounted venting apparatus. The cleaning requirement is often accomplished in a top down fashion, requiring access to the duct interior through the roof mounted vent apparatus.

Many through the roof ventilation devices are known, most are fabricated from sheet metal and some are made from injection molded plastics. Most of these have some feature for mounting the vent apparatus to the roof structure and have some form of rain protection. For powered exhaust applications, many have a damper to prevent downdraft when not in use. Current vent devices known in the art have flaws leading to premature failure and leaking, which can result in damage to the interior structure or other problems such as mold and insect or vermin damage. There is a need for an improved roof ventilation apparatus for passive applications and for powered exhaust applications.

Because of harsh environments on a roof, an improved vent apparatus is desired.

SUMMARY OF THE INVENTION

The new vent provides superior flashing, allowing application to a metal roof or interleaving within the shingled roof, creating true water shedding, a watertight seal preventing ingress of pooled water on the roof from snow accumulation or ice damming, superior resistance to sunlight and UV degradation, and consistently increasing outward flow cross-sectional dimensions enhancing flow performance. Downdraft and ambient wind causing damper rattle are prevented. The invention prevents condensate freeze-up and directs condensate drainage away from functional features and outward onto the roof surface. The new vents provide easy access for periodic cleaning of the exhaust ducts and easy to install bird and rodent prevention. Simple installation is provided with the ability to connect to 3" or 4" exhaust conduit/hoses. The new vents are easy to seal and install on metal roof covering material or in shingles. The new vents aesthetically are pleasing when installed and are shaped to shed falling rain or snow and to have low profiles on roofs. The new vents have structure built to last the life of a roof or longer and are cost effective for the contractors and building owners.

In an alternate embodiment, for use on metal roofing surfaces, the flashing plate geometry is suitably sized and shaped to allow installation on a metal roof surface using self-drilling sheet metal screws. For this embodiment an adhesive covered gasket element is applied to the bottom surface of the flashing plate allowing quick and secure placement during installation. This adhesive covered gasket is sized to allow a predetermined area of the metal flashing plate at the extreme perimeter to remain exposed for adhesion to roofing caulk applied around the entire flashing plate perimeter as a last step of the installation process for the metal surface mounted forced air exhaust vent apparatus.

An external vent is constructed out of solid coated steel material and strong plastic structure.

A flashing plate has a base and a raised portion with a gasket receiver surrounding a central opening. A gasket is positioned in the gasket receiver. A support body contacting the gasket is held in the flashing plate. The support body has a raised edge around a center opening. A damper covers the center opening. One end of the damper is hinged to the support body. A cap connected to the support body extends over the support body and the damper.

The raised portion of the support plate is deep drawn outward from the steel base. The gasket receiver is formed from a center of the raised portion by rounding an inner edge of the central opening of the raised portion successively inward, downward, inward and upward. The formed gasket receiver extends toward the base. An inner wall of the gasket receiver extends upward away from the base.

The gasket is a U-shaped sealing ring and has a bottom portion and parallel spaced side portions extending upward from the bottom portion.

The support body has a downward extending rim inserted between the spaced side portions of the sealing ring in the gasket receiver. The sealing ring and downward extending rim of the support body are captured in the gasket receiver by crimping one or both of the gasket receiver walls inward.

A thickened lower edge on the downward extending rim holds the rim in contact with the sealing ring in the gasket receiver on the flashing plate when the gasket receiver is crimped. The support structure thus is joined permanently to the flashing plate.

The support body has an outer wall spaced outward from the downward extending rim. A sloping middle wall extends inward from the top of the outer wall and the downward extending rim. A vertical wall extends upward from an inner edge of the sloping middle wall. A sloping upper wall extends inward from the vertical wall. The sloping upper wall has a central opening with a raised edge.

The structural body has axle supports. The damper has an axle with ends mounted on the axle supports. The axle is spaced outward from the raised edge of the central opening, allowing the damper to open and substantially close the central opening.

Clips are connected to opposite lower edges of the outer wall of the support body.

Tinnerman fasteners are connected on opposite sides of the outer wall. A polymer cap extends downward around the outer wall, leaving a large space for air flow inside the cap and out past a lower edge of the middle sloping wall. Openings are provided near lower side edges of the cap for alignment with the Tinnerman clips.

An outer coated steel cap covers the polymer inner cap. Openings in opposite side walls of the outer coated steel cap receive fasteners for the Tinnerman clips. Two fasteners are removed to lift the caps from the support body to clean the vent. A duct connector connects to the downward extending rim inside of the support body. The support body and the upper end of the duct connector are connected by lanced and pressed snap connectors providing a quick permanent connection of the duct connector to the support body. The assembled vent and the duct connector are separated in a compact package and are easily permanently connected by pushing the assembled vent and the duct connector together.

The packaged vent contains a screen which may be joined to the inner cap and to the open front of the support body outer wall by tab extensions fitting into openings.

The rugged roof vent is created for metal roofs or shingle roofs. For metal roofs a flashing plate has a rounded upper edge and holes or dimples for fasteners and a 3M adhesive under layer with a peel-off sheet. For a shingle roof, a larger flashing has nail holes along its upper edges.

Both flashings are made of 24 gauge galvanized, primed and KYNAR coated plates. A deep drawn raised center and gasket receiver surround a central opening. A U-shaped EPDM rubber gasket holds a rim of an angled base support body. The gasket and rim are permanently crimped in the gasket receiver. The angle of the support body allows for condensation drainage. Built-in wind walls and EPDM rubber noise dampers eliminate clatter and allow a small amount of warm air flow, helping to prevent freezing in winter.

A passivated stainless steel axle is staked to an anodized aluminum damper. The axle rotates in grooves atop two vertical columns.

A subcap of a premium ASA polymer provides extreme performance for a lifetime of service. A 24 gauge galvanized steel KYNAR-coated cap tightly covers the subcap.

316L marine grade stainless steel Tinnerman clips are mounted on a lower edge of an outer wall of the base support body. Black oxide stainless steel fasteners extend through openings near lower edges of the caps to hold the caps assembled and to allow removal of the caps for cleaning.

These and further and other objects and features of the invention are apparent in the disclosure, which includes the above and ongoing written specification, with the claims and the drawings.

DETAILED DESCRIPTION

Figure 1:
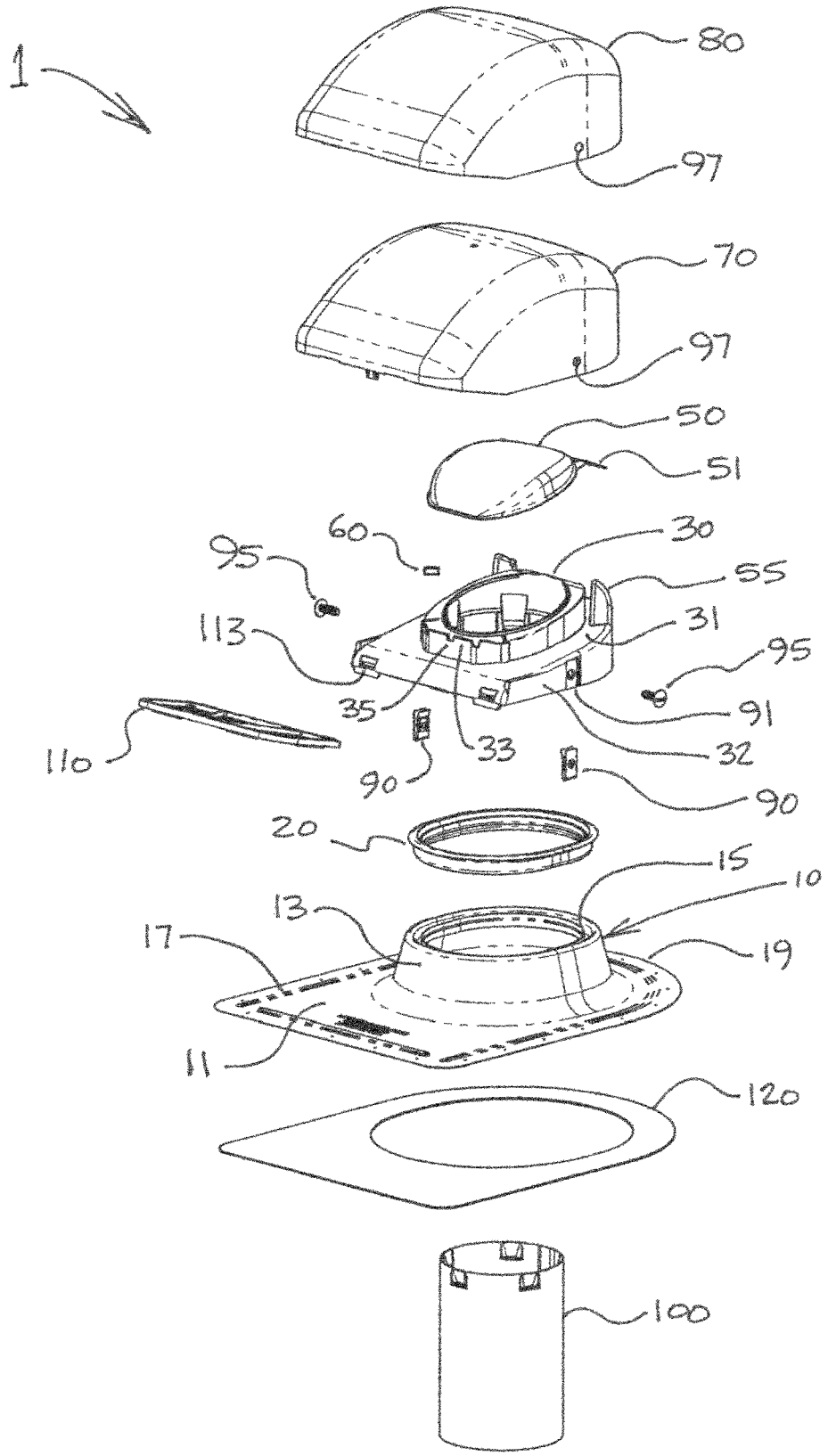
FIG. 1 is an exploded view of parts of the vent.

The new roof vent 1 has a flashing plate base 10 that is large and flat at the bottom 11 and has a deep drawn raised central portion 13 that supports a housing structural body 30 inside a premium acrylonitrile styrene acrylate (ASA) subcap 70 within a galvanized steel KYNAR polyvinylidene fluoride (PVDF) coated outer cap 80. The inner and outer caps are joined to the housing structural body 30 with machine grade marine grade stainless steel clip 90 and black oxide stainless steel screws 95.

In one embodiment a rectangular large flat bottom has nailing slots at its sides, which are for use on a shingle roof. The slots are replaced with dimples or holes 17 all around for screwing to metal roofs. A duct connector 100 quickly and permanently attaches to the internal housing structure.

Figure 2:
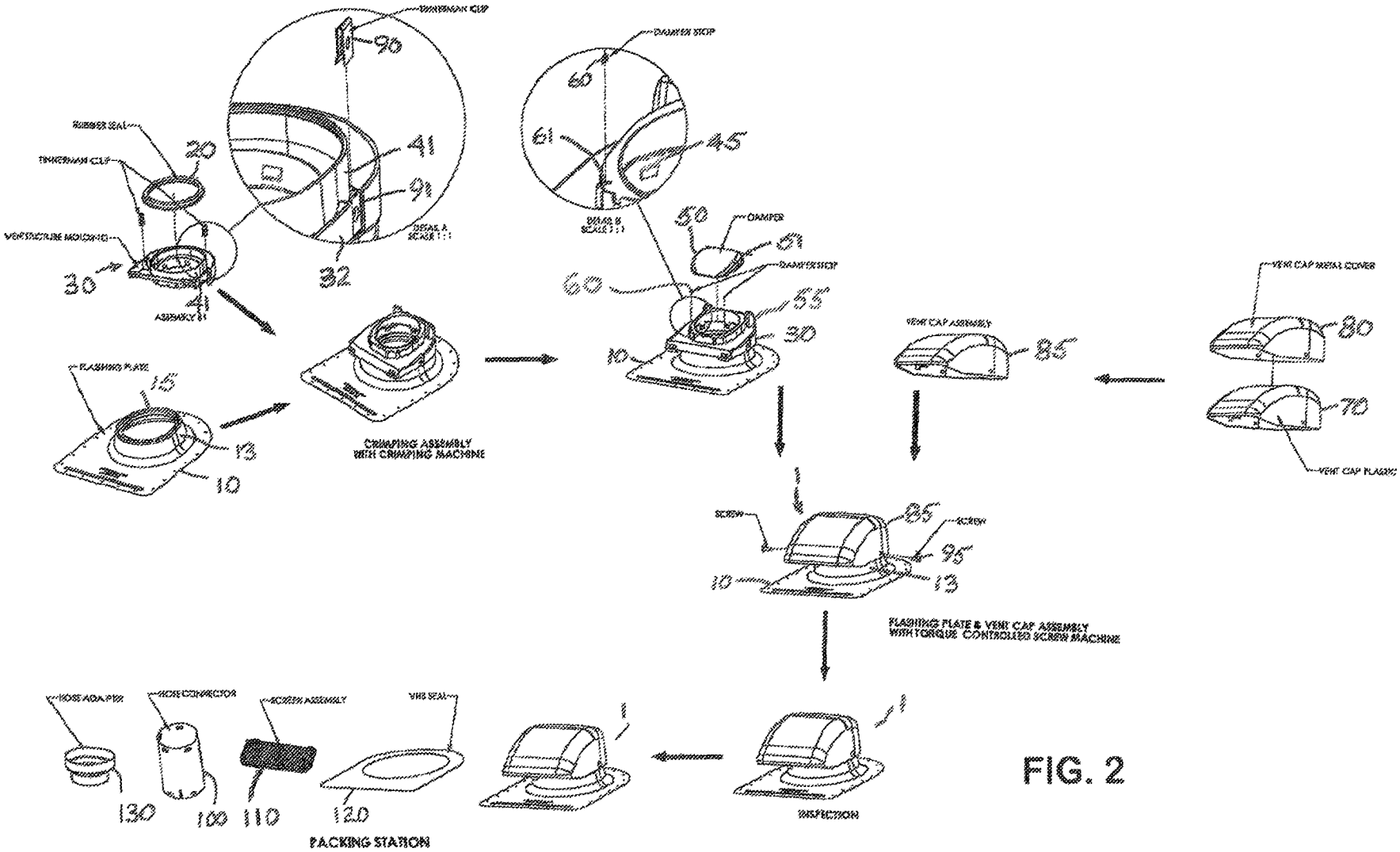
FIG. 2 shows the parts and assembly steps.

FIG. 1 is an exploded view of the roof vent. The flashing plate 10 is a 24 gauge galvanized, primed and KYNAR-coated plate with screw holes 17 or preparatory dimples along all edges, including the rounded top edge 19. A large flat base 11 has a deep drawn raised central portion 13 with a top gasket receiver crimping groove 15 that receives an ethylene polypropylene diene monomer (EPDM) gasket 20. The gasket is inserted in the top groove 15 of the base 10. The groove is crimped around the gasket after it is inserted on a downward protruding rim 41 in the housing structural body 30, as shown in FIG. 2.

The angled middle wall 31 of the housing structure 30 allows for condensation drainage. The built-in wind walls 33 are separated by drainage openings 35. EPDM noise plugs 60 inserted in the upper wall 38 of the housing structure 30 eliminate clatter of the aluminum damper 50. The noise reducer plugs 60 hold the damper 50 slightly open and allow a small amount of warm air flow outward between the lower edge of the damper 50 and the sloped upper wall 38 of housing structure 30, helping prevention of freezing of condensate in winter.

Situated on sloped upper wall 38 at the terminal airflow exit from housing structure 30 is a raised inner rim 39 which acts to prevent condensate drainage on sloped upper wall 38 from entering the airflow exit bore connected to the exhaust duct from the interior living space of the building. The perimeter of the lower edge of damper 50 is sized to be larger than the perimeter of the raised inner rim 39 and is positions such that when in the closed condition the perimeter of the lower edge of damper 50 completely circumscribes the raised inner rim 39. This predetermined sizing and positioning permits any condensate which may form on the underside of damper 50 from warm moist natural air movement from within the living spaces of the building to drain and drip from the lower edge perimeter of the damper 50 onto the sloped upper wall 38 and drain outward and downward onto sloped surface 31 and out onto the roof surface. When in use the damper 50 is opened rotationally about damper axle 51 held in recess 56 by differential air pressure. When in the open and in-use condition any condensate which forms on the damper 50 will drain along the inner surfaces of the domed damper to the lowest portion of the perimeter and drip off onto sloped upper surface 38 and drain downward and outward on the roof surface. Condensate drainage is again protected from entering the exhaust duct by raised inner rim 39. Damper axles 51 are situated outside of the lower edge perimeter of damper 50 such that no dripping of condensate can flow to or enter the recess 56 which captures and provides bearing surfaces for axle 51 on either side of damper 50.

The deep drawn domed shaped damper 50 has a passivated stainless steel axle 51 fixed to one side of the damper. The domed shaped geometry provides structure and rigidity even though the damper is formed of thin lightweight materials.

Subcap 70 is made of a premium ASA polymer that provides extreme performance for a lifetime of service. A 24 gauge galvanized steel KYNAR-coated outer cap 80 provides long life protection of the assembly. Joined together, the inner and outer caps are cap assembly 85.

Two marine grade stainless steel fastener clips 90 slide-up grooves 91 in outer sides 32 of the housing structure 30. Black oxide stainless steel threaded fasteners 95 extend through openings 97 in sides of the outer cap 80 and the subcap 70 and tightly engage the caps with the clips 90 on the housing structure 30. Removing fasteners 95 enables the caps to be lifted, which is important for clothes dryer vent cleaning.

A screen 110 is provided for connection between the inner cap 70 and the housing structure 30. The duct connection pipe 100 to be inserted before installation completes the roof vent 1 assembly.

A pressure sensitive very high bond (VHB) seal 120 is also provided for metal roof application.

FIG. 2 shows assembly of the roof vent. The roof vent is assembled after the large flashing plate 10 has the deep drawn central portion 13 formed with an inward crimping gasket receiver 15. The housing structure 30 is shown in an inverted position with its downward protruding rim 41 ready to receive EPDM rubber gasket 20. The detail "A" of the inverted housing structure 30 shows a Tinnerman clip 90 being placed over the edge in the recesses 91 of the outer side wall 32 of the housing structure 30.

The housing structure 30 with the gasket 20 in place is turned right side up, and the gasket 20 with the inserted inner rim ring 41 is pushed into the gasket receiver 15 in the top of the flashing plate 10. The gasket receiver is then crimped tightly and permanently with a crimping machine, holding the gasket 20 and the housing structure 30 connected permanently with the flashing plate 10.

Detail "B" shows one of the receiving holes 61 for receiving the plugs 60 that are noise reducers and damper stops for preventing full closure of the damper 50. Detail "B" also shows the internal duct connector receiving holes 45 that permanently secure the duct connector pipe 100 to the housing structure 30.

The next step is adding the damper 50 with its stainless-steel axle 51 held in recesses 56 at the top of upward projections 55 on the housing structure 30. Outward ends of stainless-steel axle 51 are held and rotate within recesses 56 when the damper 50 is forced open by differential pressure. The positioning of recesses 56 at the top of upward projections 55 is outside of the main perimeter of the domed shaped damper 50 and any condensate which may form and drain from the inner surfaces of domed shaped damper 50 will drain downward and away from the recesses 56 thereby aiding in the prevention of moisture accumulation within recesses 56 which might freeze during cold temperatures potentially preventing proper operation of the damper 50.

The metal outer vent cap 80 is mounted on the inner ASA plastic subcap 70, forming a cap assembly 85. The combined vent caps 80 and 70 in cap assembly 85 are joined in the vent assembly 1 with a torque controlled screw machine tightening the black oxide coated threaded stainless steel fasteners 95 in the marine grade stainless steel fastener clips 90 on the housing structure 30.

After inspection 2 of the assembled parts, the assembled roof vent 1 is wrapped and packaged with separately wrapped VHB seal 120, screen assembly 110, duct connector 100 and a duct adapter 130 for connecting the vent assembly 1 with a duct connector 100 to a smaller vent duct.

Figure 3:
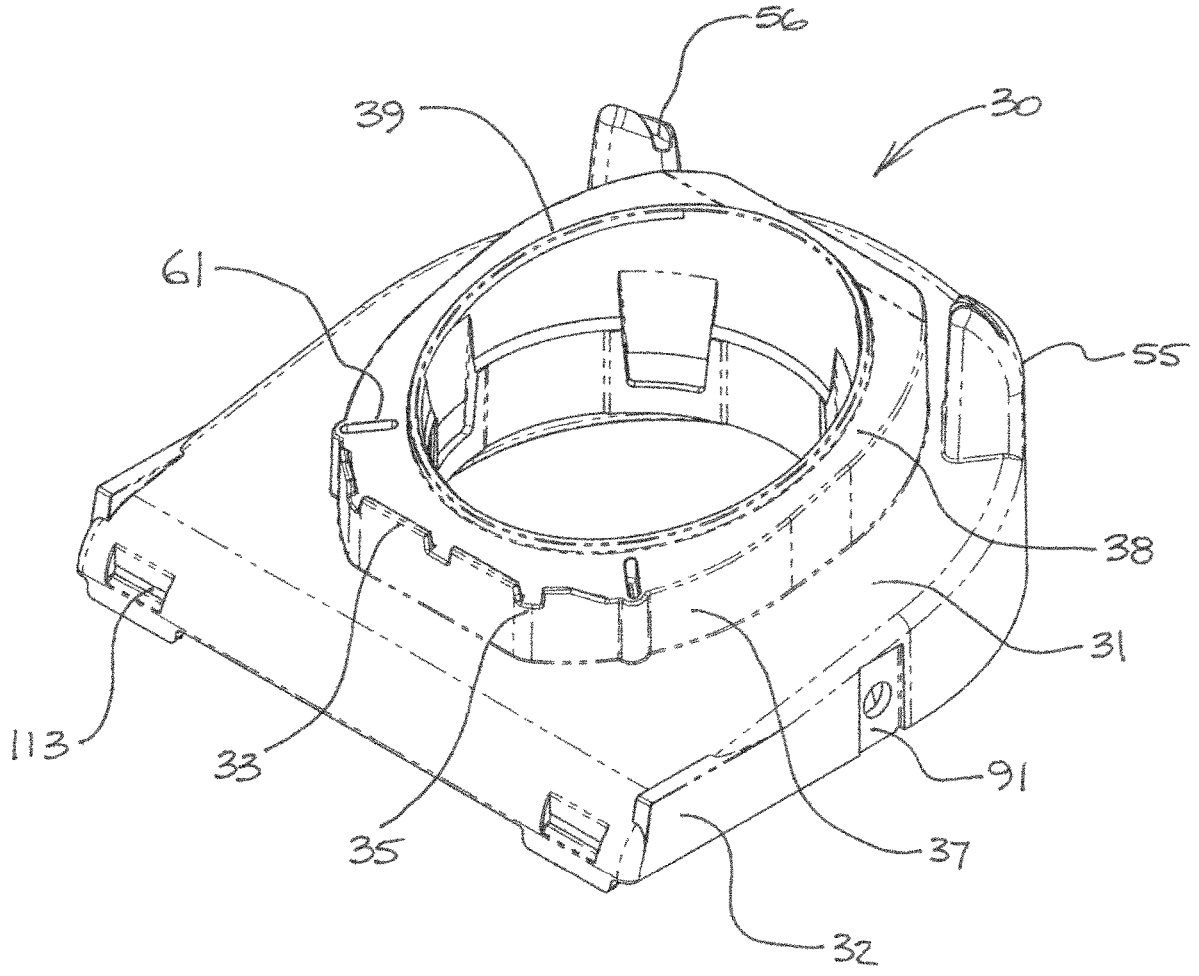
FIG. 3 is a perspective view of the vent structural molding.
Figure 4:
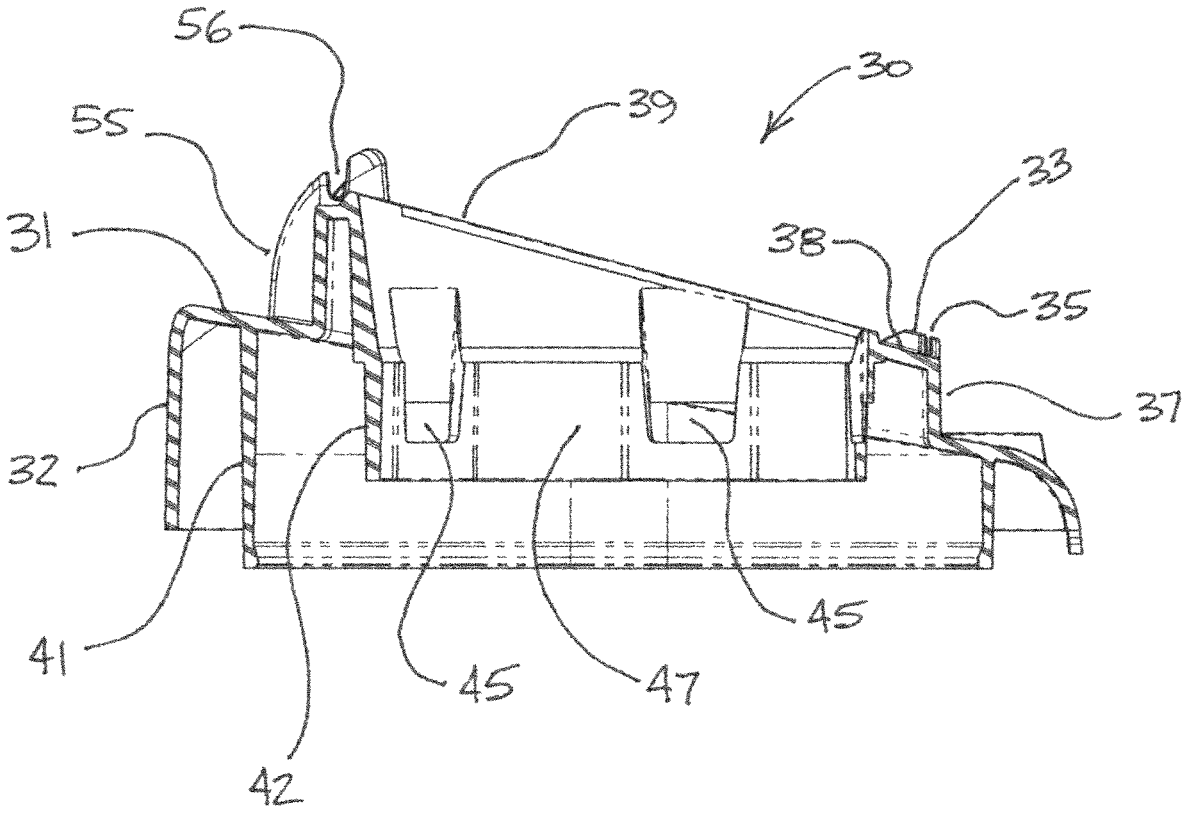
FIG. 4 is a cross section side view of the vent structural molding.

As shown in FIGS. 3 and 4, the housing structure 30 has a raised annular sloped middle wall 31 which drains water and condensate outward from the structure. A surrounding outer wall 32 is spaced outward from the raised central part 13 of the flashing plate 10, as shown in FIGS. 1 and 2. A raised vertical wall 37 of the housing structure 30 supports a flat sloping upper wall 38 and an inner rim 39 which underlie the damper. This raised inner rim 39 has a smaller perimeter than the terminal lower edge of the damper 50 so that any and all condensate formed on the underside of the domed metal damper 50 will drain to the outside of raised inner rim 39 onto sloping upper wall 38 where it can drain downward and out of the vent onto the roof surface. In this manner the larger perimeter of damper 50 and the smaller perimeter of inner rim 39 act to prevent condensate from draining backwards into the duct from the living space of the building. A front of the vertical wall 37 has raised wind walls 33 which deter incoming wind from lifting the damper 50. Drain openings 35 between the wind walls 33 drain any condensate from upper wall 38. Noise-reducing damper stops 60 are permanently plugged into holes 61 in the upper wall 38 to prevent clatter and to slightly raise the lower edge of damper 50 relative to upper wall 38 to allow rising warm air to prevent freezing of condensate.

The down flow prevention damper 50 is manufactured from a thin sheet metal and covers the inner rim 39. An inner perimeter of damper 50 is larger than the outer perimeter of the inner rim 39. Damper 50 is pivotally coupled to displace angularly about an axle 51. Axle 51 allows the domed damper 50 to rotate to a closed position when no forced air exhaust is flowing and to an open position when forced exhaust flow is present. The mass of the damper 50 closes it when no positive air flow exhaust is present. The domed shape of damper 50 coupled with its enlarged inner perimeter allows any condensate which might form on the inner domes surface to flow outward to points peripherally outside the inner rim 39 that the damper covers, thereby preventing condensate from running back down into the exhaust conduit hose. The sloped upper wall 38 receives the dripped condensate and guides it down towards the terminal exit of the vent apparatus 1 and down and onto the sloped roof.

Figure 11:
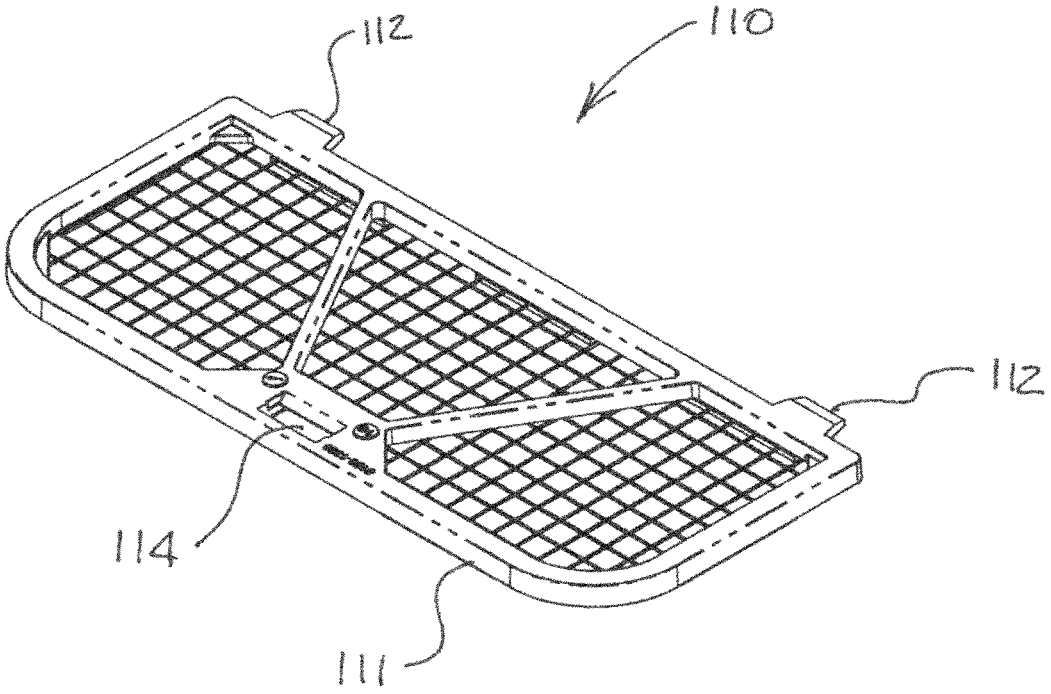
FIG. 11 is a perspective view of the removable screen.

Slight recesses 91 in the outer sides 32 of the housing structure 30 receive Tinnerman clips 90. Holes 113 in the front of the housing structure 30 shown in FIG. 3 receive tabs 112 at the bottom of the screen 110, as shown in FIG. 11. The upward projecting posts 55 at the rear of the housing structure body 30 have receiver grooves 56 for holding ends of the axle 51 of the damper 50, as shown in FIGS. 2, 3, 4 and 7.

Figure 5:
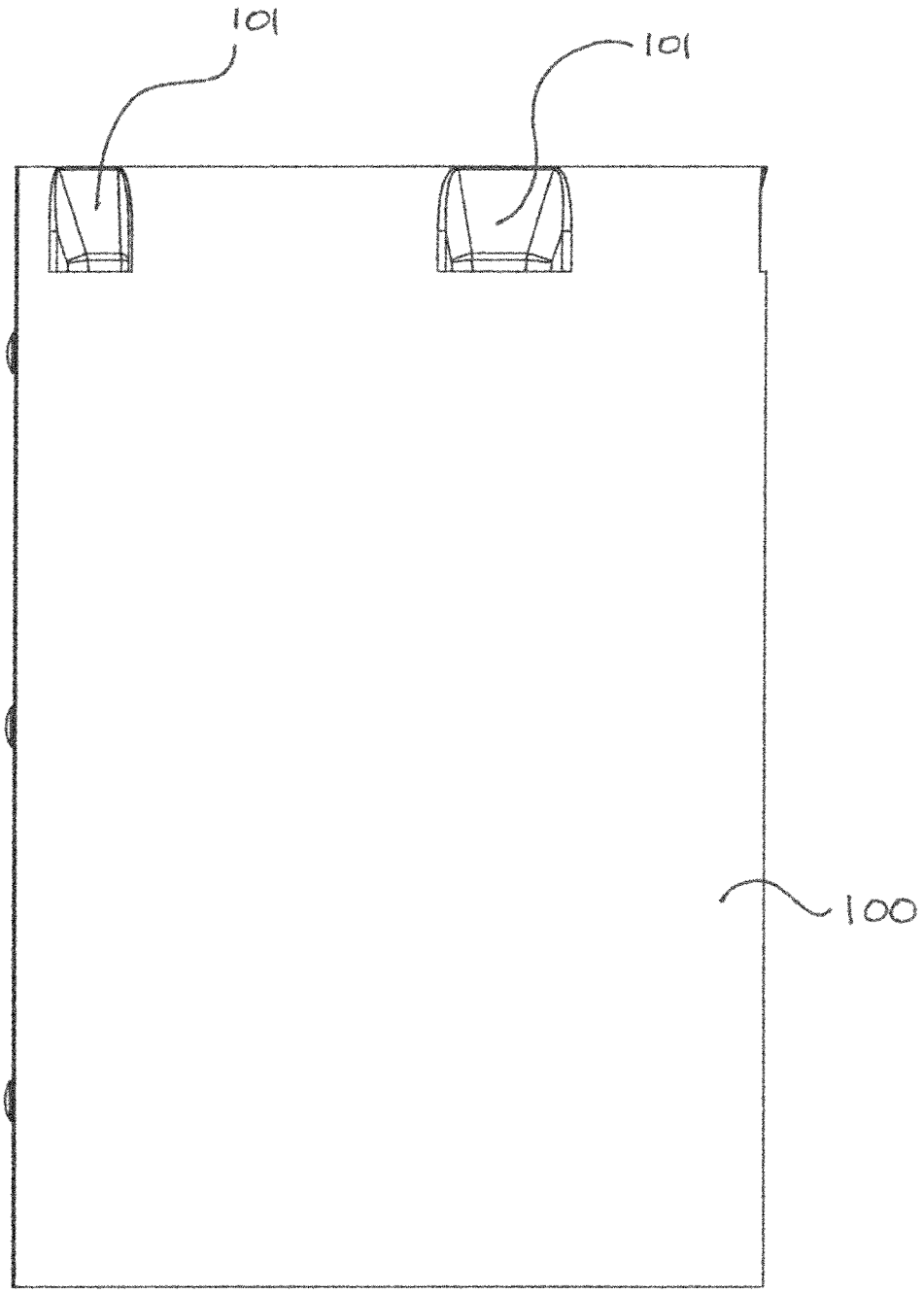
FIG. 5 is a side view of the duct connector.
Figure 6:
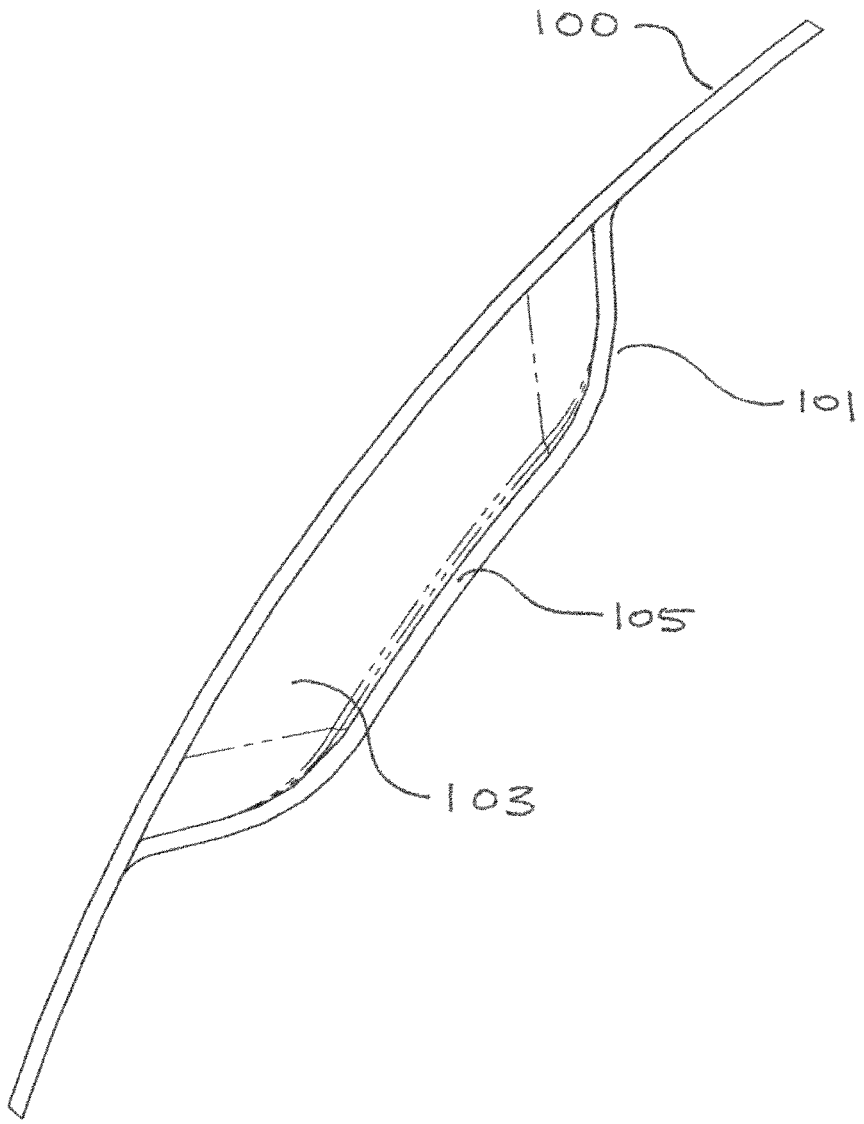
FIG. 6 is a detail of the duct connector.

FIG. 5 is a side view of the duct drop connector 100. The duct connector 100 is easily, quickly and permanently connected to support body 30 of vent 1. The duct connector is an important part that allows an entire roof vent assembly to be packaged and protected for shipping and then to be easily, quickly and permanently assembled in the vent for connecting the vent to a building vent duct or hose before installation of the vent on a roof. The duct connector 100 has small pierced and bent inward connections 101 with sloped tops 103 and flat bottoms 105, as shown in the bottom view detail of FIG. 6. As the duct connection is inserted over the round wall 42 on the housing structure 30, the sloped tops 103 push inward on walls of the structure body 30 until the flat bottoms 105 of duct connector 100 project through windows 45 in the downward extending round wall 42 of the housing structure 30. The flat bottoms 105 engage the windows 45, in a one-way locking fashion, preventing withdrawing of the duct connector from the housing structure 30 once installed.

In some applications a polymeric label with pressure sensitive adhesive on one side may be utilized by wrapping the label circumferentially around the pierced end of the duct connector 100 providing instructions for the installation and physically closing and blocking fluid communication which might be possible through the openings formed when piercing the feature 101 in the duct connection tube 100.

Figure 7:
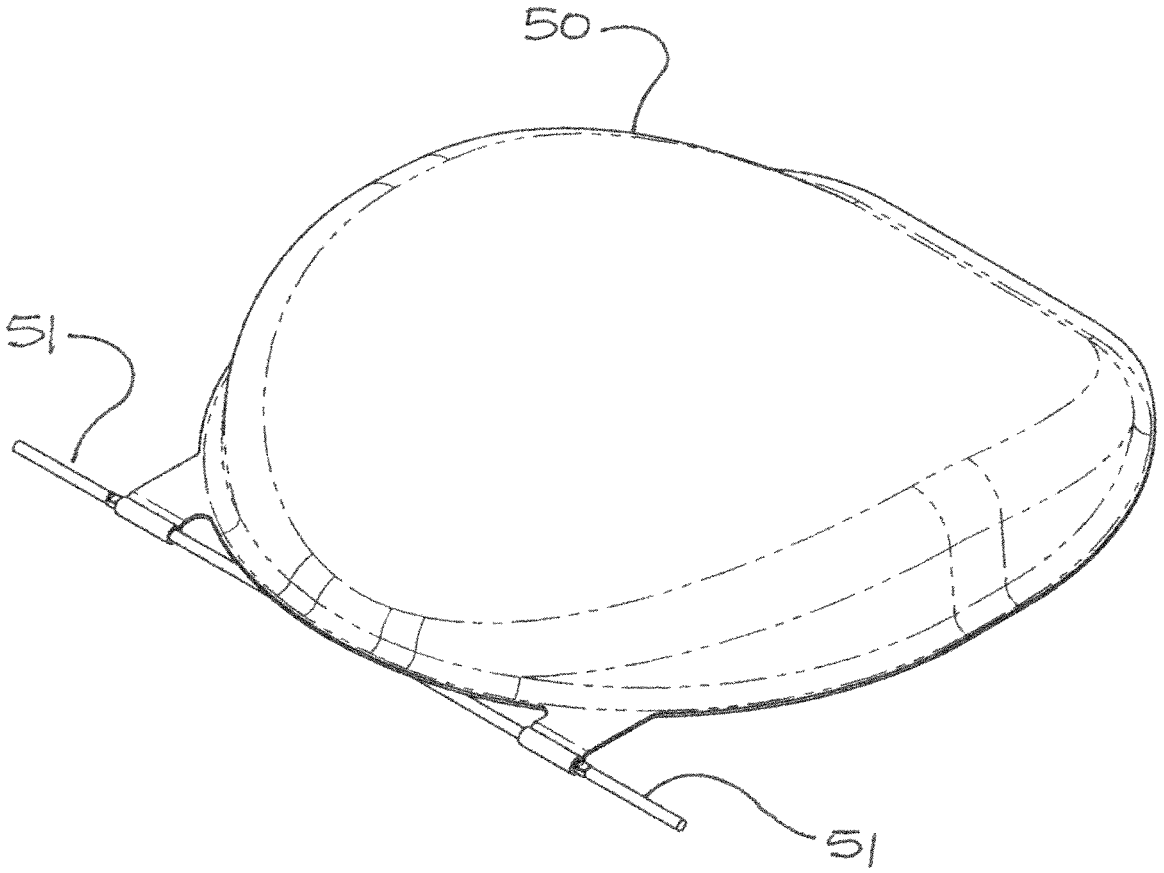
FIG. 7 is a perspective view of the damper.

FIG. 7 is a detail of the anodized aluminum damper 50 crimped and staked to the axle 51.

Figure 8:
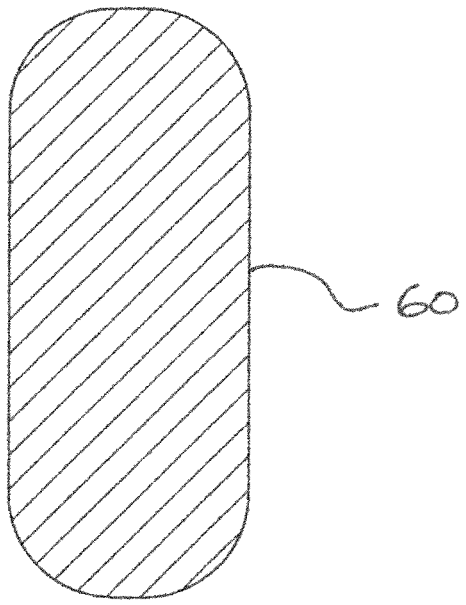
FIG. 8 is a cross-section view of a damper stop.

FIG. 8 is a cross-sectional enlarged view of the resilient damper stop plug 60.

Figure 9:
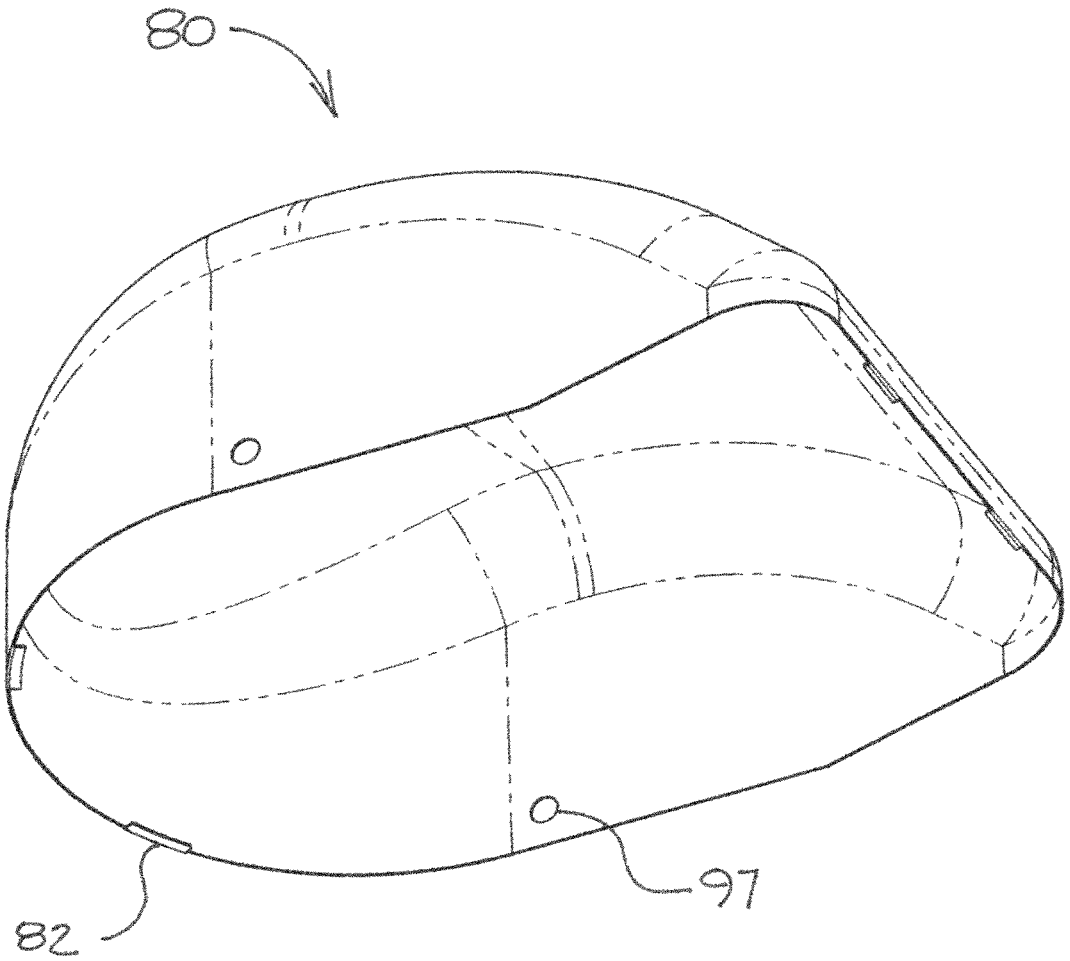
FIG. 9 is a perspective view of the outer metal vent cover.

FIG. 9 is an inside perspective view of the galvanized steel KYNAR-coated outer cap 80. Tabs 82 are permanently bent inward to secure the outer cap 80 to the inner cap 70. The outer cap 80 is made from deep drawn zinc coated galvanized steel covered with a KYNAR PVDF coating. Holes 97 in sides receive fasteners. The outer cap fits tightly over the inner cap 70.

Figure 10:
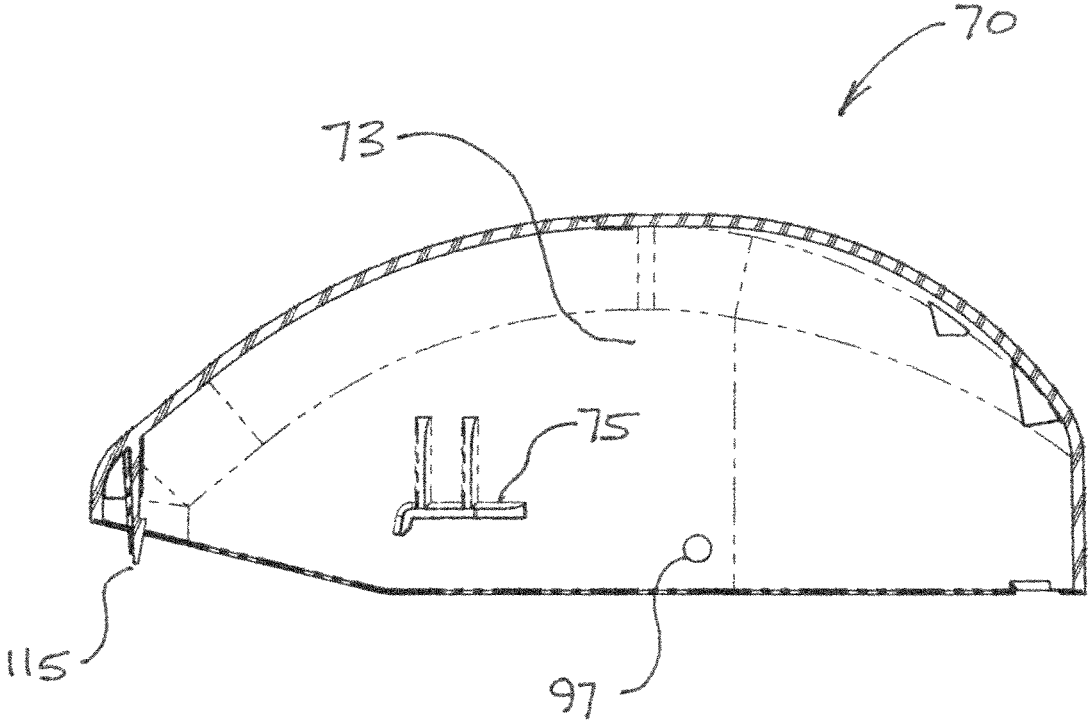
FIG. 10 is a side cross section of the inner molded vent cover.

FIG. 10 is a side cross-sectional view of the ASA polymer inner cap 70. The inner cap 70 is made out of ASA polymer to tightly fit inside the outer cap 80. Aligned holes 97 in sides of caps 80 and 70 receive fasteners. The sides 73 of the inner cap 70 fit tightly around the outer wall 32 of the housing structure 30, as shown in FIG. 3. Inner elements 75 rest on angled middle wall 31 of the housing structure 30 and provide a stopping surface for the Cap assembly 85 when installed. Likewise, the top surfaces of upper projections 55 of the housing structure 30 provide another stopping surface allowing the inner surface of polymer inner cap 70 to rest when cap assembly 85 is installed. The structure provided by these stopping surfaces positions the cap assembly 85 correctly for alignment of holes 97 in the cap assembly 85 and the speed nut fastener 90 affixed to the housing structure 30. In addition, the structure provided by these stopping surfaces prevents damage due to high forces applied to the top of cap assembly 85, for example a person stepping on the vent inadvertently.

FIG. 11 is a perspective view of a screen assembly 110 that fits in the outer vent opening between the structural body 30 and the inner cap 70. The frame 111 has tabs 112 to fit in holes 113 in the structural body 30 shown in FIG. 3. A hole 114 connects to clip 115 in inner cap 70 shown in FIG. 10.

Figure 12:
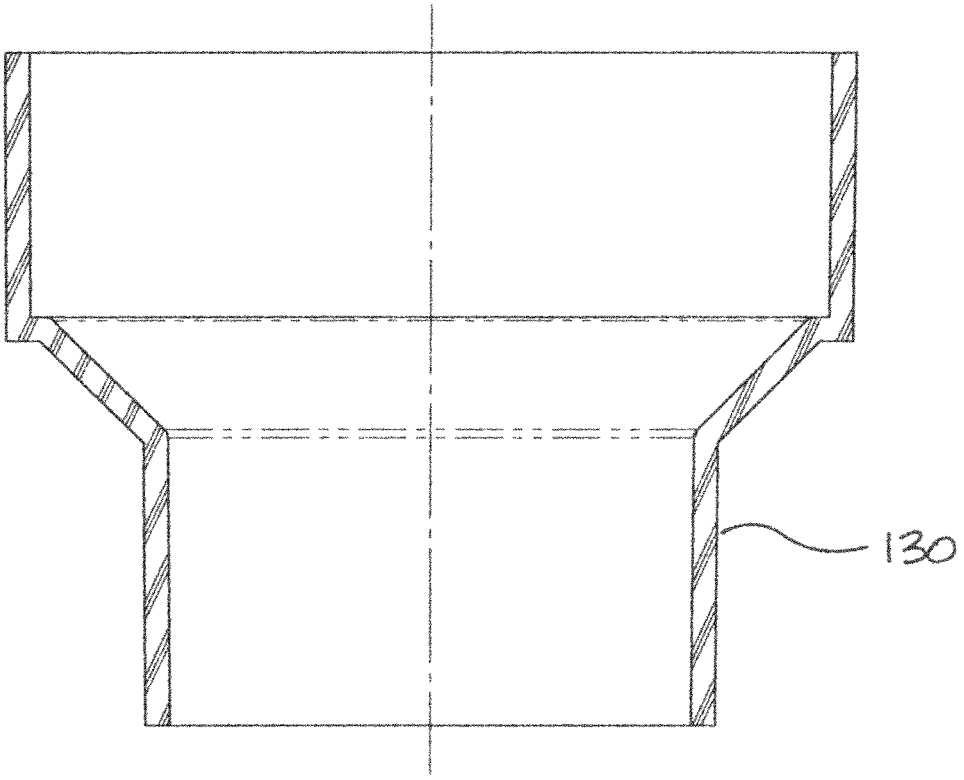
FIG. 12 is a cross sectional view of a duct connector adapter.

FIG. 12 shows a cross-section of a 4" to 3" reducer 130, as shown in FIG. 2.

Figure 13:
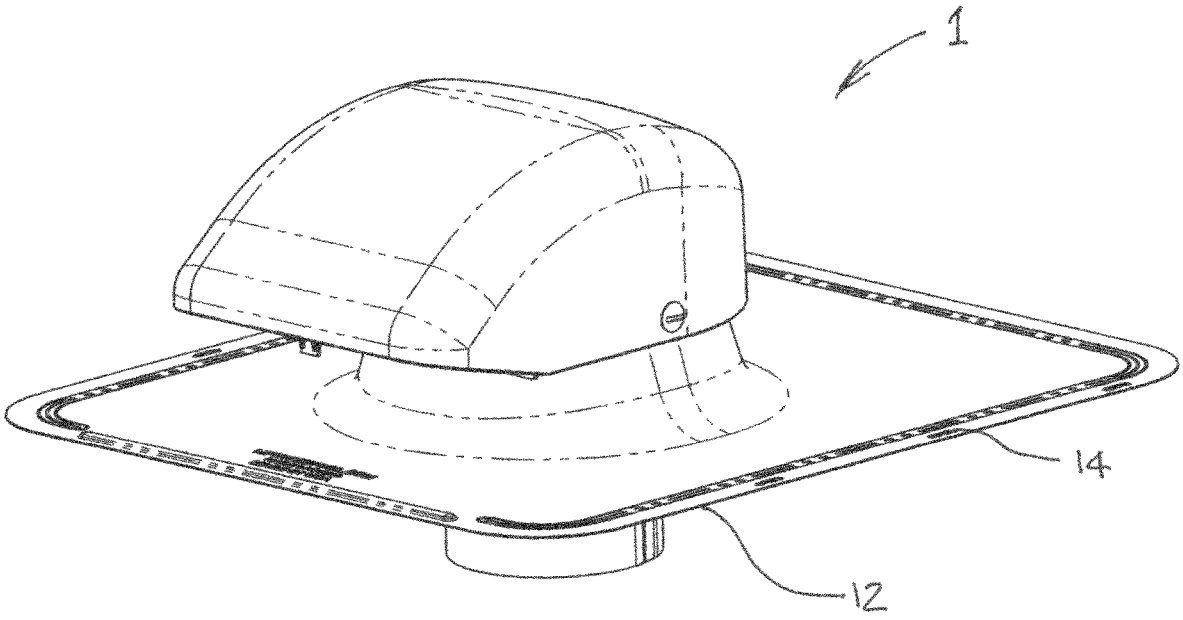
FIG. 13 is an isometric view of the roof mounted forced air exhaust vent apparatus ready for installation on a sloped roof surface, adapted for use with shingled, slate, or tile roof covering materials.

FIG. 13 shows a vent 1 with a flashing plate 12 with nailing slots 14 configured for mounting on a shingled roof.

Figure 14:
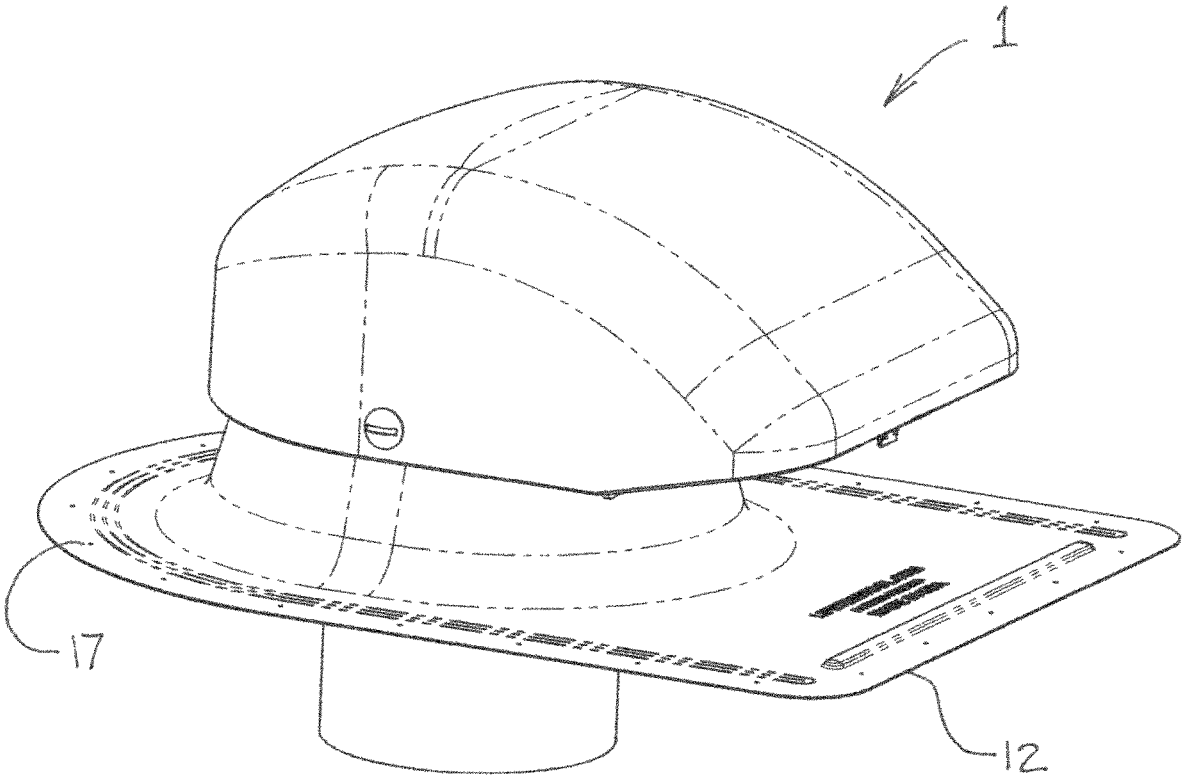
FIG. 14 is a view of the roof mounted forced air exhaust vent apparatus ready for installation on a sloped roof surface, adapted for use with metal roof covering materials.

FIG. 14 shows a vent 1 with a flashing plate 12 with fastener holes or indentations 17 configured for mounting on a metal roof.

Figure 15:
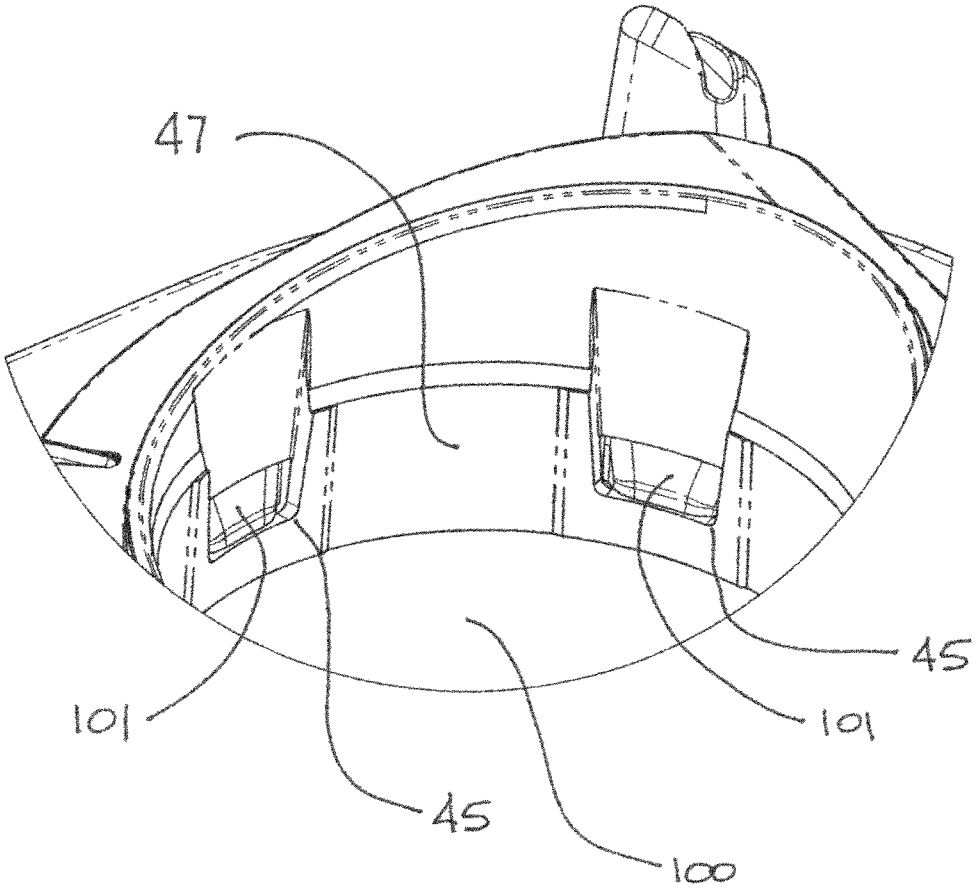
FIG. 15 shows a connection between the housing structure and the duct connector.

FIG. 15 shows a detail of the housing structure 30. The bent inward connections 101 of duct connector 100 protrude through the windows 45 in the housing inner cylindrical wall 47.

It is important to note that the cross-sectional area for air flow through the vent changes in a manner to always increase with each transition through the device. As such, the cross-sectional area for flow at the duct connection is the smallest flow area in the device. The geometry of the domed damper 50 acts to shape the airflow and reduce drag and the cross-sectional area open for flow beneath the damper 50 when opened is larger than the cross-sectional area at the duct connection. The cross-sectional area open for flow though the screen assembly 110 is again larger than the cross-sectional area for air flow beneath the damper 50 when opened. Finally, the cross-sectional area for air flow at the terminal exit from the vent with the screen assembly 100 removed is larger than the cross-sectional area for air flow through the screen assembly 110. This cascading to ever larger cross-sectional areas for air flow through the device serves to keep the drag or pressure drop through the device minimized.

While the invention has been described with reference to specific embodiments, materials of construction, modifications and variations of the invention may be constructed without departing from the scope of the invention, which is defined in the following claims.

We claim:

1. An external vent comprising:

a flashing plate having a base having a raised portion of the flashing plate and a gasket receiver surrounding a central opening in the raised portion, a gasket in the gasket receiver, a support body contacting the gasket and held with the gasket in the flashing plate, the support body having a center opening, a damper covering the center opening, one end of the damper hinged to the support body and, a cap connected to the support body and extending over the support body and the damper.

2. The external vents of claim 1, wherein the raised portion of the flashing plate is deep drawn outward from the base, and the gasket receiver is formed around the central opening from a center of the raised portion by rounding an inner edge of the raised portion inward, downward, inward and upward, the gasket receiver having an outer wall extending toward the base and having an inner wall of the gasket receiver extending upward away from the base.

3. The external vents of claim 2, wherein the gasket is a U-shaped sealing ring and wherein the sealing ring has a bottom portion and spaced side portions extending upward from the bottom portion.

4. The external vents of claim 3, wherein the support body has a downward extending rim positioned between the spaced side portions of the sealing ring and wherein the sealing ring and downward extending rim are captured in the gasket receiver by crimping at least one of the gasket receiver walls inward.

5. The external vents of claim 4, further comprising a thickened lower edge on the downward extending rim for holding the rim in contact with the sealing ring, the gasket receiver, and the flashing plate when the gasket receiver is crimped.

6. The external vents of claim 4, wherein the support body further comprises an outer wall spaced outward from the downward extending rim and a sloping middle wall extending inward from a top of the outer wall over the downward extending rim, a vertical wall extending upward from the sloping middle wall and a sloping upper wall extending inward from the vertical wall to a raised edge around the central opening.

7. The external vents of claim 6, wherein the structural body has axle supports, and wherein the damper has an axle with ends mounted on the axle supports for holding the axle spaced outward from the central opening for positioning the damper above the raised edge of the central opening.

8. The external vents of claim 6, further comprising clips connected to opposite lower edges of the outer wall of the support body and fasteners connecting opposite side walls of the cap.

9. The external vents of claim 8, wherein the cap is an inner cap, further comprising an outer cap on the inner cap and openings in opposite side walls of the outer cap aligning with the openings in the inner cap for the fasteners.

10. The external vents of claim 1, further comprising a duct connector connected to an inside of the support body.

11. The external vents of claim 10, wherein the support body and the upper end of the duct connector are connected by windows in the support body and pierced and extended portions of the duct connector extending into windows in an inner wall of the support body.

12. The external vents of claim 1, further comprising a size reducer adapted for connecting the hose connector to a small hose.

13. The external vents of claim 1, further comprising a screen configured for connecting between the support body and the cap.

14. Apparatus comprising:

roof vents for baths and laundry dryers, each roof vent further comprising a base having a flat flashing plate with a deep drawn upward extending riser spaced from edges of the flat flashing plate and a rounded downward, inward and upward gasket receiver crimping trough formed around a central opening of the base, a structural body having a central sloping wall and an outer wall extending downward from an outer edge of the central sloping wall, a sloping upper wall and an annular intermediate wall connecting the sloping upper wall with the central sloping wall, a central opening in the upper sloping wall, a rim extending downward from the central sloping wall inside of the outer wall, a U-shaped sealing ring gasket having a bottom and two spaced sides extending upward from the bottom of the gasket, the rim being inserted between the sides of the gasket, and the rim and the gasket being inserted in the gasket receiver crimping trough and the gasket receiver crimping trough being crimped to hold the rim and gasket securely and permanently in a crimped gasket receiver crimping trough.

15. The apparatus of claim 14, wherein the structural body has an inner wall extending downward from the central opening and the inner wall has windows spaced upward from a lower edge of the inner wall, further comprising a duct connector having lanced and bent portions with edges extending from the duct connector and adapted for pressing the lanced and bent portions toward the windows and permitting the lower edges of the lanced and bent portions to engage the windows in permanent connection of the windows in the inner wall, with the lanced and bent portions of the duct connector.

16. The apparatus of claim 14, further comprising wind walls extending upward from a front of the sloping upper wall and drain openings between the wind walls.

17. The apparatus of claim 16, further comprising damper stops positioned in the upper sloping wall near the wind walls.

18. The apparatus of claim 14, further comprising posts extending upward from the central sloping wall and aligned grooves in the top of the posts, an axle extending between the aligned grooves and a damper connected to the axle and extending over the central opening in the upper wall.

19. A method comprising:

providing a flashing plate with a raised central portion, forming a gasket receiver around a central opening in the raised central portion, providing a support body with a central opening and a downward protruding rim, providing a U-shaped gasket, placing the gasket on the protruding rim, inserting the gasket and the protruding rim in the gasket receiver, crimping the gasket receiver and permanently connecting the flashing plate and support body, hinging a damper on the support body for opening and closing the central opening of the support body, providing a cap spaced over the damper and the central opening in the support body, and removably securing the cap to the support body.

20. The method of claim 19, comprising:

providing first and second objects, of dissimilar materials, providing a connection between the dissimilar objects, further comprising providing openings in a first wall of a first object, providing a similarly shaped second wall of a second object, forming complementary projections on the similarly shaped second wall, moving the first and second walls together, resiliently deforming borders of the openings or the formed complementary projections upon moving the first and second walls together, restoring the deformed borders or projections when the projections and openings are aligned, and extending the projections into the openings and thereby connecting the first and second objects.

* * * * *